US008464416B2

(12) United States Patent
Adkins et al.

(10) Patent No.: US 8,464,416 B2
(45) Date of Patent: Jun. 18, 2013

(54) METHOD FOR MANUFACTURING A RAILING ASSEMBLY

(75) Inventors: Willard Adkins, Land O'Lakes, FL (US); Fredrich M. Hilpert, Brooksville, FL (US)

(73) Assignees: Willard Adkins, Land O'Lakes, FL (US); William Woodard, Land O'Lakes, FL (US)

( * ) Notice: Subject to any disclaimer, the term of this patent is extended or adjusted under 35 U.S.C. 154(b) by 166 days.

(21) Appl. No.: 13/032,275

(22) Filed: Feb. 22, 2011

(65) Prior Publication Data

US 2011/0204308 A1 Aug. 25, 2011

Related U.S. Application Data

(60) Provisional application No. 61/307,753, filed on Feb. 24, 2001.

(51) Int. Cl.
*E04H 17/14* (2006.01)
*B21D 39/00* (2006.01)

(52) U.S. Cl.
USPC ..... 29/525.01

(58) Field of Classification Search
USPC ..... 29/453, 525.01, 525.02, 525.14; 256/22, 256/59, 65.01, 65.14, 65.15, 21, 65.02, 65.03; 52/720.2, 832
See application file for complete search history.

(56) References Cited

U.S. PATENT DOCUMENTS

| | | | |
|---|---|---|---|
| 4,014,520 | A | 3/1977 | Walters |
| 4,968,005 | A | 11/1990 | Zen |
| 5,002,260 | A | 3/1991 | Lustvee |
| 6,811,146 | B1 | 11/2004 | Giralt |
| 7,168,689 | B2 | 1/2007 | Giralt |
| 7,322,564 | B2 | 1/2008 | Fakhari |
| 7,347,412 | B1 | 3/2008 | Zhu |

OTHER PUBLICATIONS

Gulf Aluminum Products, Inc. drawing dated Jan. 19, 2004.
Gulf Aluminum Products, Inc. drawing sheet G-4 dated Apr. 10, 2002.
Eastern Metal Supply, Inc. drawing dated Jan. 4, 2001.
Giralt Enterprises, Inc. "Aluminum Pedestrian / Bicycle Picket Railing QPL Index No. DI 860-001" drawing dated Apr. 30, 2002.
Eastern Metal Supply, Inc. "Handrailing 01" drawing dated Sep. 1, 2005.
Eastern Metal Supply, Inc. "Handrailing 02" drawing dated Sep. 1, 2005.
Eastern Metal Supply, Inc. "Handrailing 03" drawing dated Sep. 1, 2005.
Eastern Metal Supply, Inc. "Handrailing 11" drawing dated Sep. 1, 2005.

*Primary Examiner* — Jermie Cozart
(74) *Attorney, Agent, or Firm* — Ronald E. Smith; Smith & Hopen, P.A.

(57) ABSTRACT

A railing and method of manufacturing the railing provide for a guard rail having an upper and lower railing and pickets extending between the upper and lower railing joined to posts such that a rib extends from a surface of one or both of the railings bites into an end of the pickets preventing chattering. The method may use a jig to clamp the railings and pickets together during joining to the posts, such as by welding.

14 Claims, 3 Drawing Sheets

FIG. 5
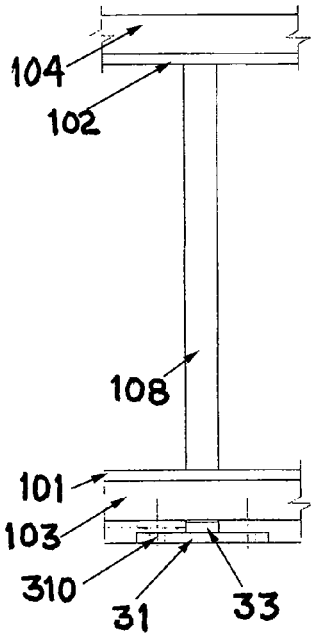
FIG. 3
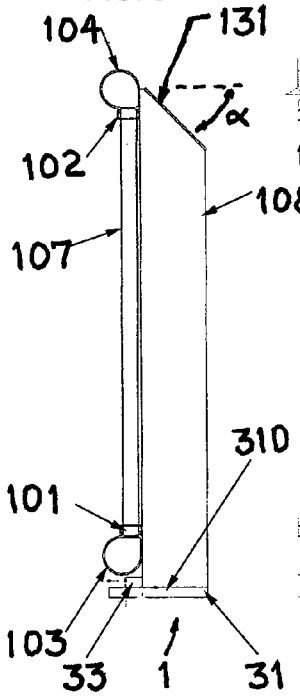
FIG. 4
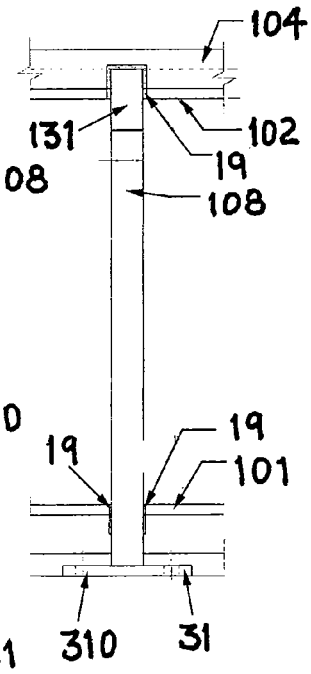
FIG. 2
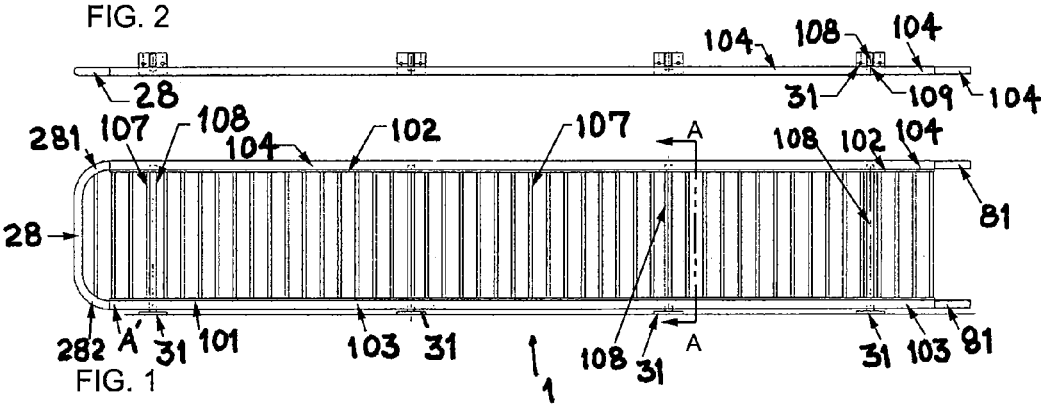
FIG. 1

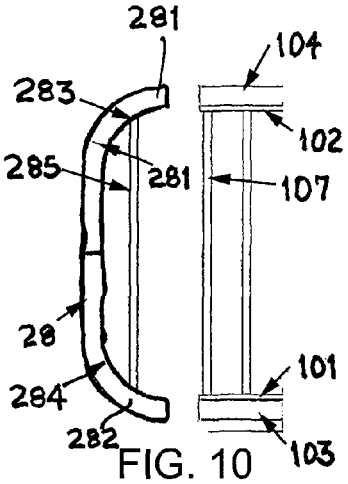
FIG. 10
FIG. 15
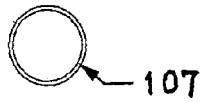
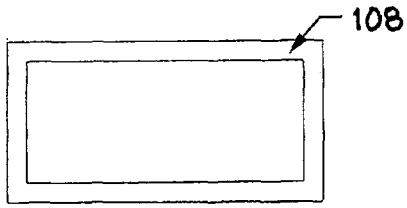
FIG. 14
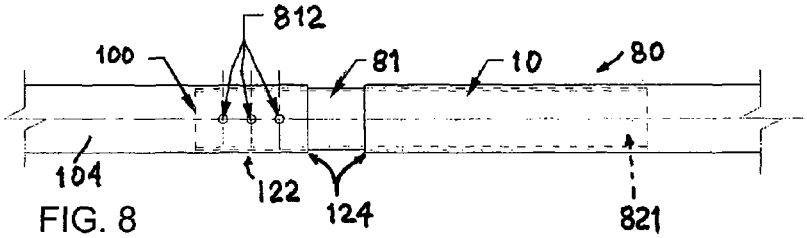
FIG. 8
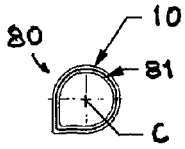
FIG. 9
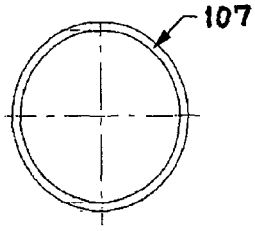
FIG. 11
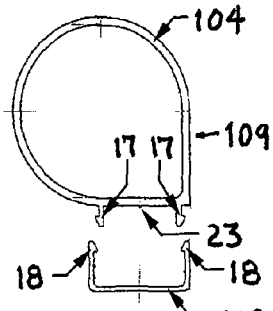
FIG. 12
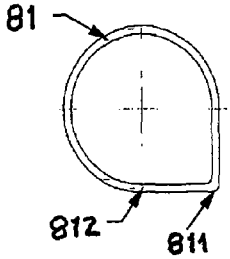
FIG. 13

METHOD FOR MANUFACTURING A RAILING ASSEMBLY

REFERENCE TO RELATED APPLICATION

This application claims the benefit of the filing date of U.S. Provisional Patent Application No. 61/307,753 filed Feb. 24, 2010, the description and figures of which are hereby incorporated by reference in its entirety.

FIELD OF THE INVENTION

The field is railing, particularly pedestrian guardrails with vertical pickets.

BACKGROUND

Pedestrian guardrails with vertical pickets are known and used in private and public works projects, but such rails require cutting and welding of structures on the jobsite in order to fit the rails to terrain and to mounting structures.

SUMMARY OF THE INVENTION

A method of manufacturing a railing assembly comprises a system of assembly that provides a railing assembly easily installed on a jobsite, reducing labor costs and time for installation. A plurality of holes is formed in a lower channel and an upper channel, such as by punching. The lower channel is fitted into a lower rail, and the upper channel is fitted into the upper rail, such as by snapping. A plurality of pickets is positioned in each of the plurality of holes in the upper channel and the lower channel, forming a rails and pickets assembly. The rails and pickets assembly is mounted in a jig, such that a flat surface of the upper rail and a flat surface of the lower rail are exposed. A plurality of posts are disposed at a beam spacing distance of the jig such that a flat portion of each of the posts contacts the flat surfaces of the upper rail and the flat surface of the lower rail. Then, each of the posts are joined to the upper rail and the lower rail such that the rails and pickets assembly is permanently joined together, such as by welding of the flat portion of each of the posts to the flat surface of the upper rail and the flat surface of the lower rail.

In one example, snap fit connectors are formed on an underside of a shaped, tubular rail for each of the upper rail and lower rail, which are identical, and the U-shaped channels, which are also identical for the lower and upper channels, have corresponding snap fit connectors extending from each end of a U-shaped channel profile of the channels, such that snap fit connectors of the channels snap over the snap fit connectors extending from the underside of the tubular rails. For example, the snap fit connectors and the rails may be formed such that a portion of the rails and a side of the channels form a flat, planar surface, allowing a welding bead to join a flat portion of a post and the flat, planar surface of both the rail and channel.

Chattering caused by movement of metal pickets in the channel may be suppressed by a raised rib extending from the underside surface of the rails, such that the raised rib bites into a surface of each of the pickets when the rail assembly is clamped together and welded to the posts. Surprisingly, no other attachment or device is needed to suppress chattering, and the raised rib is easily formed in the surface of the rail during forming of the tubular profile without the addition of a significant volume of metal, such as formable alloys of aluminum, magnesium, steel, titanium or the like. Preferably, a heat treatable and weldable metal having a good formability is used in the manufacturing of the components of the railing assembly.

More particularly, the novel method for manufacturing a railing assembly includes the steps of providing an elongate upper rail and an elongate lower rail, integrally forming a first set of front snap fit connectors and back snap fit connectors with the elongate upper and lower rails at predetermined, longitudinally spaced apart intervals so that the first set of front and back snap fit connectors depend from the elongate upper rail and project upwardly from the elongate lower rail, and providing an elongate upper channel having an upwardly-opening square U-shape and providing an elongate lower channel having a downwardly-opening square U-shape. A second set of front snap fit connectors and back snap fit connectors is integrally formed with the elongate upper and lower channels at predetermined, longitudinally spaced apart intervals that substantially correspond to the intervals of the first set of front and back snap fit connectors, said second set of front and back snap fit connectors projecting upwardly from the elongate upper channel and projecting downwardly from the elongate lower channel. Further method steps include interlocking the upper rail to the upper channel by snapping together the first set of snap fit connectors formed in the upper rail and the second set of snap fit connectors formed in the upper channel, interlocking the lower rail to the lower channel by snapping together the first set of snap fit connectors formed in the lower rail and the second set of snap fit connectors formed in the lower channel. Still further steps include forming a plurality of openings in the upper rail and in the lower rail at predetermined longitudinally spaced intervals so that the openings formed in the upper and lower rails are in vertical alignment with one another, and positioning a plurality of vertically disposed pickets along respective extents of the upper and lower rails with respective upper ends of the pickets disposed in respective openings formed in the upper channel and with respective lower ends of the pickets disposed in respective openings formed in the lower channel. A plurality of vertically upstanding posts is provided and the posts are positioned along the extent of the railing assembly in longitudinally spaced apart relation to one another. An upper end of each post of said plurality of posts is secured to the upper rail and a lower end of each post of said plurality of posts is secured to the lower rail. A lower end of each post is provided with a base adapted to be secured to a support surface for the railing assembly. Each post is dimensioned to have a vertical extent that exceeds a combined vertical extent of the upper rail, upper channel, pickets, lower rail and lower channel assembly so that the lower rail is vertically spaced apart from the support surface. An elongate flat is formed in the elongate upper rail and the elongate lower rail. A flat is also formed in each post at its upper end and its lower end. The flat formed in the upper end of each post is secured to the flat formed in the elongate upper rail. The flat formed in the lower end of each post is secured to the flat formed in the elongate lower rail. A secure and stable connection is therefore formed between the posts and the rails. A first plurality of ribs is integrally formed on a lower surface of the upper rail so that each rib of the plurality of ribs is in registration with each of the openings formed in the upper channel so that when the first set of snap fit connectors that are integrally formed with the upper rail snap-fittingly engages the second set of snap fit connectors that are integrally formed with the upper channel, each rib of the first plurality of ribs bears against an upper end of an associated picket to substantially inhibit movement of the upper end of the associated picket. In the same way, a second plurality of ribs is integrally formed on an upper surface of the lower rail so that each rib of the second plurality of ribs is in registration with each of the openings formed in the lower channel so that when the first set of snap fit connectors that are integrally formed with the lower rail snap-fittingly engages the second set of snap fit connectors that are integrally formed with the lower channel, each rib of the second plurality of ribs bears again a lower end of an associated picket to substantially inhibit movement of the lower end of the associated picket. One advantage of the railing assembly and method of manufacture is that the design is manufacturable from simple extrusions with minimal post extrusion machining, stamping and welding. Another advantage is that the railing assembly may be installed by bolting the base plates to fixtures cast into footings in the ground. Yet another advantage is that time and labor costs for installing railing assemblies to complete a project are reduced compared to known railings that require cutting or more complicated assembly, or both, at the jobsite and more complicated welding operations or installation steps, or both. The costs of materials and assemblies are reduced compared to known railings due to efficiencies in use of materials and fabrication of the assemblies. The ornamental design of the railings is highly attractive and distinctive without introducing substantial additional costs for materials and labor and while substantially reducing such costs in comparison with known railings of comparable quality and aesthetic appeal.

BRIEF DESCRIPTION OF THE DRAWINGS

FIG. 1 illustrates a front plan view of a plurality of railing assemblies formed according to a method of manufacturing a railing assembly and joined together in an installation.

FIG. 2 illustrates a top plan view of the installation illustrated in FIG. 1.

FIG. 3 illustrates a side plan view of one end of a railing assembly mounted to a post.

FIG. 4 illustrates a detailed, back plan view of a post having an end cap joined to a portion of a railing assembly (pickets intentionally omitted for clarity).

FIG. 5 illustrates a detailed, front plan view of a post joined to a portion of a railing assembly (pickets intentionally omitted for clarity).

FIG. 8 illustrates a detailed view of an expansion joint.

FIG. 9 illustrates a detailed cross sectional view of an expansion joint.

FIG. 10 illustrates an exploded, detailed view of and end section and a portion of a railing assembly.

FIG. 11 illustrates a tubular pipe having a circular cross section.

FIG. 12 illustrates a cross sectional, exploded view of a rail and channel.

FIG. 13 illustrates an end view of a splicing member.

FIG. 14 illustrates a cross sectional view of a post.

FIG. 15 illustrates an end view of a picket.

DETAILED DESCRIPTION

Figure 7:
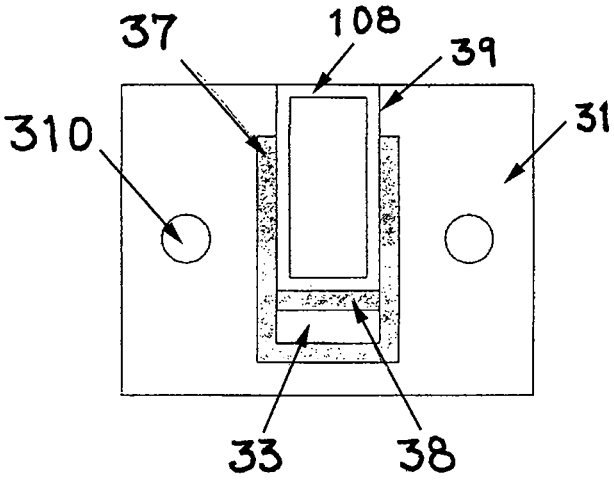
FIG. 7 illustrates a detailed, partial cross sectional view of a post welded to a base plate and a block.

The examples described and the drawings rendered are illustrative and are not to be read as limiting the scope of the invention as it is defined by the appended claims.

A method of manufacturing a railing assembly as illustrated in the drawings of FIGS. 1-15 comprises a system of assembly that provides a railing assembly 1 easily installed on a jobsite, reducing labor costs and time for installation. A plurality of holes 105 are punched in a lower channel and an upper channel 101, 102, which may be identical parts. The lower channel 101 is snapped onto a lower rail 103, and the upper channel 102 is snapped onto the upper rail 104. The upper and lower rails may be identical parts. A plurality of pickets 107 are positioned in each of the plurality of holes 105 in the upper channel and the lower channel, forming a rails and pickets assembly. The rails and pickets assembly is mounted in a jig, such that a flat surface 109 of the upper rail and a flat surface 109 of the lower rail are exposed. A plurality of posts 108 are disposed at a beam spacing distance of the jig such that a flat portion of each of the posts 108 contacts the flat surfaces 109 of the upper rail 104 and the lower rail 103. Then, each of the posts 108 are joined to the upper rail 104 and the lower rail 103 such that the rails and pickets assembly is permanently joined together, such as by welding of the flat portion of each of the posts 108 to the flat surface 109 of the upper rail 104 and the flat surface 109 of the lower rail 103.

Figure 6:
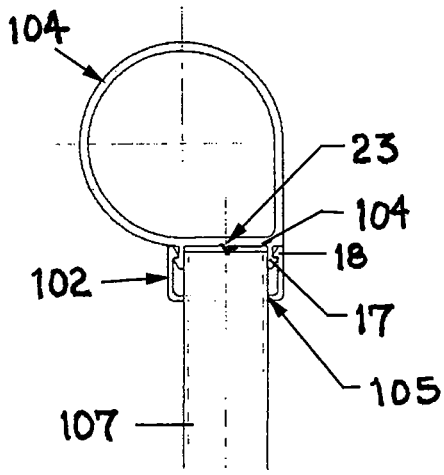
FIG. 6 illustrates a detailed, partial cross sectional view of an upper rail, an upper channel and a portion of a picket.

In one example, the flat surface 109 of the upper rail 104 includes a portion 109 of the upper rail 104 and a portion of the upper channel 102, and the flat surface of the lower rail 103 includes a portion of the lower rail and a portion of the lower channel 101. In one example, snap fit connectors 17 are formed on an underside of a shaped, tubular rail for each of the upper rail 104 and lower rail 103, which are identical, and the U-shaped channels 101,102, which are also identical for the lower and upper channels, have corresponding snap fit connectors 18 extending from each end of a U-shaped channel profile of the channels, such that snap fit connectors 18 of the channels 101,102 snap over the snap fit connectors 17 extending from the underside of the tubular rails. For example, the snap fit connectors 17 and the rails 103,104 may be formed such that a portion of the rails and a side of the channels form a flat, planar surface, allowing a welding bead 19 to join a flat portion of a post and the flat, planar surface of both the rail and channel, as illustrated in FIGS. 4, 6 and 12, for example.

In one example, a rib 23 is formed on a bottom surface of the upper rail 104, extending from the bottom surface of the upper rail 104 and extending longitudinally along a length of the upper rail, and the rails and pickets assembly is mounted into the jig such that the rib 23 bites into an upper surface of each of the plurality of pickets 107, when the pickets 107 are fitted into holes 105 formed in the upper and lower channels. For example, a clamping force pushes the rib 23 into contact with a portion of the surface at an end of each of the plurality of pickets 107 such that the rib 23 bites into the end surface of each of the plurality of pickets 107 locking the plurality of pickets 107 into intimate contact with the rib 23, after the joining process between the posts 108 and the rails 103,104 is completed.

In one example, a lower end of each of the plurality of posts 108 is joined to a base plate 31, and each of the base plates 31 are fixed to one of a plurality of fixtures using a fastener to a threaded stud extending through holes 310 for supporting the plurality of posts 108. For example, the lower end of each of the plurality of posts 108 may be welded to the base plate 31, and the step of welding may include a weldment 38 from a forward portion of each of the plurality of posts 108 along a side portion 37 of each of the plurality of posts in contact with one of the base plates 31, stopping at a distance from a back surface of each of the plurality of posts leaving a segment 39 of the post without a weld. A block 33 may be welded to the forward portion of each of the plurality of posts 108 reinforcing the strength of the joint between each of the plurality of posts 108 and its respective base plate 31, the block 33 being joined to the respective base plate 31, such as by welding or adhering of the block 33 to the base plate 31, for example. In one example, friction stir welding is used to join at least one portion of the block 33 or the post 108 to the base plate 31.

In one example, a rail expansion joint 80, such as illustrated in FIGS. 8 and 9, is used to join a first railing assembly 100 to second railing assembly 10. For example, a plurality of splicing members 81 may be made that are each insertable into the lower rails 103 and the upper rails 104. For example, the splicing members 81 may have the same cross sectional shape as both the lower rails 103 and the upper rails 104, which lower rails and upper rails may be identical, in one example. One end of the splicing member 81 may be inserted into an upper rail 104 and may be plug welded at one or more holes 812 formed in an end portion 122 of the upper rail 104. The same may be accomplished for the lower rail 103. The opposite end 821 of the splicing members 81 may be inserted into the respective upper rail and lower rail of a second railing assembly 10 positioned adjacent to the first 100. By not welding the splicing member 81 to the second railing assembly 10, the splicing member 81 provides a slip fit allowing for thermal expansion, settling and other relative motion between the first railing assembly 100 and the second railing assembly 10. A bevel or rounded edge 124 of the each of the upper and lower rails of the railing assemblies joined by expansion joints may provide for a continuous appearance at the expansion joint. An elbow 811 of the splicing member 81 is rounded to fit the profile of the rail 104. The inflection point 812 is likewise designed for insuring a good fit with the rail 103,104.

An end section may include a tubular assembly 28 having opposite ends 281,282, each insertable into one of the upper rail 104 or the lower rail 103, such as illustrated in FIGS. 1, 2 and 10. The tubular assembly may include arcuate portions 283,284 extending from each of the opposite ends 281,282 and an elongated linear portion 280 extending between the arcuate portions 283,284, such that one of the opposite ends 281 may be fitted into the upper rail 104 of a railing assembly 100, and the opposite end 282 of the tubular assembly from the first of the opposite ends 281 may be fitted into an end of the lower rail 103 of the same railing assembly 100, such as illustrated in the detail of FIG. 10, for example. In one example, a picket 285 extends from the first arcuate portion 283 to an opposite arcuate portion 284 of the end section 28. The opposite ends 281,282 of the end section 28 may have the same cross sectional tubular shape as the upper and lower rails 103,104 but may be sized to be readily insertable into the tubular upper and lower rails in a similar fashion to the splicing member 81 illustrated in FIGS. 9 and 13, for example.

FIG. 15, illustrates a view of the end of a picket 107, 285 having a round tubular cross section, as illustrated in detailed view of FIG. 11.

In one example, a picket 107 may substantially overlap with a post 108, as illustrated in FIG. 1, which shows pickets 107 adjacent to or overlapping various posts 108 extending upward from base plates 31. Each post may have an end 131 opposite of the base plate 31 that is cut at an angle and between 10° and 75° from the horizontal direction to the post width.

Figure 16:
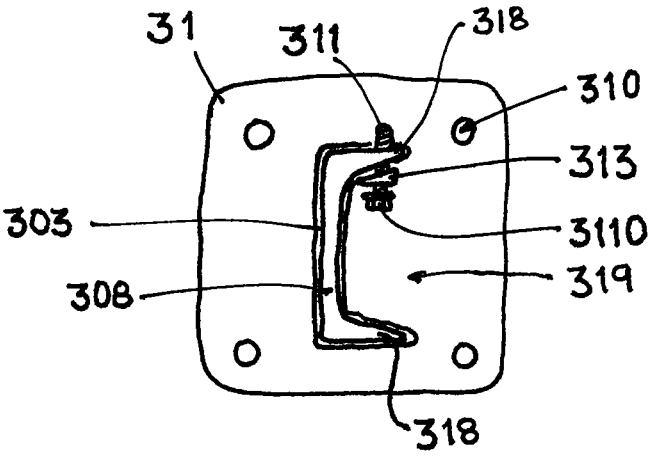
FIG. 16 illustrates a top view of an example of a post mounted on a base plate.

In an alternative example, a base plate 31 is attached to a post 108 by welding the post 108 around the outer peripheral perimeter of a post 108 with a square cross section, such as illustrated in FIG. 14, or with a cross section of a C-beam 308 or an I-beam as illustrated in the example of FIG. 16. The weldment 303 may attach the C-beam 308 to the plate, and the C-beam 308 may be joined to rail 103,104 using a bolt 311 and shaped spacer 313 with the bolt threadingly engaging one or both of the rails 103,104 after passing through a hole in the spacer 310. A cover 309 may conceal the bolts 311. The bolt or bolts 311 may be concealed within a cavity formed by opposite end 318 of the C-beam each of the ends 318 comprising a flat portion. One of the flat portions of the ends 318 is arranged to contact one or more rails. The inner cavity 319 is defined by a first end 318 and a second end opposite of the first end, both extending transversely, outwardly in the same direction in relation to the base plate 31 and the connection member of the C-beam post.

The outer surface of the two ends are substantially parallel in this example, but the inner opposing faces of the two ends diverge in a direction away from each other. The spacer 313 is selected to have an angle that is substantially the same as the angle between an outer facing surface of an end of the C-beam and an inner facing surface the same end such that the spacer can be arranged to provide a substantially flat contact surface for a bolt head 3011 of a bolt 311 passing through a hole in the end 318 of the C-beam 308.

The invention claimed is:

1. A method for manufacturing a railing assembly comprising the steps of:

forming a plurality of holes in a lower channel and an upper channel;

fitting the lower channel into a lower rail and the upper channel into the upper rail;

positioning a plurality of pickets in each of the plurality of holes in the lower channel and the upper channel within a jig such that a flat portion of the lower rail and upper rail is exposed and the lower rail, the pickets and the upper rail are compressed into contact;

joining a plurality of posts to the flat portion of the lower rail and the upper rail such that the railing assembly is fixedly joined.

2. The method of claim 1, wherein the step of joining includes the step of welding each of the plurality of posts to the respective flat portions of the lower rail and the upper rail.

3. The method of claim 2, wherein the step of joining includes the step of welding each of the plurality of posts to a flat portion of the lower channel and the upper channel aligned in the same plane as the flat portion of the lower rail and the upper rail.

4. The method of claim 1, wherein the step of positioning includes the step of clamping the lower rail, the pickets, and the upper rail such that a rib extending from a surface of the upper rail, the lower rail or both the upper rail and the lower rail bites into a respective contact surface of each of the plurality of pickets.

5. The method of claim 4, wherein the step of clamping causes the rib extending from the surface of the upper rail and the lower rail to bite into the respective contact surfaces at opposite ends of each of the plurality of pickets.

6. The method of claim 1, further comprising the step of:

welding a base plate to a lower end of each of the plurality of posts.

7. The method of claim 6, further comprising the step of:

bolting each of the base plates to a fixture for supporting the rail assembly in an installation.

8. The method of claim 6, wherein the step of welding the base plate includes the steps of providing welds from a first surface of each of the plurality of posts along a side of each of the plurality of posts, and stopping at a preselected distance from a second surface of each of the plurality of posts.

9. The method of claim 8, wherein the step of stopping includes the step of leaving at least 2 centimeters from the second surface on the side of each of the plurality of posts unwelded.

10. A method for manufacturing a railing assembly, comprising the steps of:

providing an elongate upper rail and an elongate lower rail;

integrally forming a first set of front snap fit connectors and back snap fit connectors to said elongate upper and lower rails at predetermined, longitudinally spaced apart intervals, said first set of front and back snap fit connectors depending from said elongate upper rail and projecting upwardly from said elongate lower rail;

providing an elongate upper channel having an upwardly-opening square U-shape and providing an elongate lower channel having a downwardly-opening square U-shape;

integrally forming a second set of front snap fit connectors and back snap fit connectors to said elongate upper and lower channels at predetermined, longitudinally spaced apart intervals that substantially correspond to the intervals of said first set of front and back snap fit connectors, said second set of front and back snap fit connectors projecting upwardly from said elongate upper channel and projecting downwardly from said elongate lower channel;

interlocking said upper rail to said upper channel by snapping together said first set of snap fit connectors formed in said upper rail and said second set of snap fit connectors formed in said upper channel;

interlocking said lower rail to said lower channel by snapping together said first set of snap fit connectors formed in said lower rail and said second set of snap fit connectors formed in said lower channel;

forming a plurality of openings in said upper rail and in said lower rail at predetermined longitudinally spaced intervals so that the openings formed in said upper and lower rails are in vertical alignment with one another; and positioning a plurality of vertically disposed pickets along respective extents of said upper and lower rails with respective upper ends of said pickets disposed in respective openings formed in said upper channel and with respective lower ends of said pickets disposed in respective openings formed in said lower channel.

11. The method of claim 10, further comprising the steps of:

providing a plurality of vertically upstanding posts and positioning said posts along the extent of said railing assembly in longitudinally spaced apart relation to one another;

securing an upper end of each post of said plurality of posts to said upper rail;

securing a lower end of each post of said plurality of posts to said lower rail;

providing a lower end of each post with a base adapted to be secured to a support surface for said railing assembly;

dimensioning each post to have a vertical extent that exceeds a combined vertical extent of said upper rail, upper channel, pickets, lower rail and lower channel assembly so that said lower rail is vertically spaced apart from said support surface.

12. The method of claim 11, further comprising:

forming an elongate flat in said elongate upper rail and said elongate lower rail;

forming a flat in each post at its upper end and its lower end;

securing the flat formed in the upper end of each post to the flat formed in the elongate upper rail;

securing the flat formed in the lower end of each post to the flat formed in the elongate lower rail;

whereby a secure and stable connection is formed between the posts and the rails.

13. The method of claim 10, further comprising:

integrally forming a first plurality of ribs on a lower surface of said upper rail so that each rib of said first plurality of ribs is in registration with each of said openings formed in said upper channel so that when said first set of snap fit connectors that are integrally formed with said upper rail snap-fittingly engages said second set of snap fit connectors that are integrally formed with said upper channel, each rib of said first plurality of ribs bears again an upper end of an associated picket to substantially inhibit movement of said upper end of said associated picket.

14. The method of claim 10, further comprising:

integrally forming a second plurality of ribs on an upper surface of said lower rail so that each rib of said second plurality of ribs is in registration with each of said openings formed in said lower channel so that when said first set of snap fit connectors that are integrally formed with said lower rail snap-fittingly engages said second set of snap fit connectors that are integrally formed with said lower channel, each rib of said second plurality of ribs bears against a lower end of an associated picket to substantially inhibit movement of said lower end of said associated picket.

* * * * *